US006310547B1

(12) United States Patent
Parker

(10) Patent No.: US 6,310,547 B1
(45) Date of Patent: Oct. 30, 2001

(54) ALARM SYSTEM WITH PROGRAMMABLE DEVICE CONTROL

(75) Inventor: James Parker, Thornhill (CA)

(73) Assignee: Digital Security Controls Ltd., Concord ( * ) Notice: Subject to any disclaimer, the term of this patent is extended or adjusted under 35 U.S.C. 154(b) by 0 days.

(21) Appl. No.: 09/579,526

(22) Filed: May 26, 2000

(51) Int. Cl.[7] ..... G08B 21/00

(52) U.S. Cl. ..... 340/540; 340/310.06; 340/506; 340/825.06

(58) Field of Search ..... 340/540, 506, 340/505, 310.06, 825.06, 825.07; 700/17, 83

(56) References Cited

U.S. PATENT DOCUMENTS 4,279,012 * 7/1981 Beckedorff et al. ..... 364/104
4,857,759 * 8/1989 Murphy et al. ..... 307/141
4,951,029 * 8/1990 Severson ..... 340/506
5,089,814 * 2/1992 Deluca et al. ..... 340/825.49
5,400,246 * 3/1995 Wilson et al. ..... 364/146
5,889,468 * 3/1999 Banga ..... 340/628
5,898,384 * 4/1999 Alt et al. ..... 340/825.36
6,011,755 * 1/2000 Mulhall et al. ..... 368/10

* cited by examiner

*Primary Examiner*—Daniel J. Wu
*Assistant Examiner*—Phung Nguyen

(57) ABSTRACT

An alarm system providing programmable remote control of electrically controlled devices, such as lights, is provided. Geographic site and date information is provided to the alarm system. The parameters used to dictate the activation and deactivation of the controlled devices include the geographic site location and the sunrise and sunset times for the current date at that site. Accordingly, the activation and deactivation times of the controlled devices be programmed to automatically track the shifting sunset and sunrise times at the site.

12 Claims, 7 Drawing Sheets

Figure 3

| | January | | February | | March | | | December | |
|---|---|---|---|---|---|---|---|---|---|
| Day | Rise | Set | Rise | Set | Rise | Set | | Rise | Set |
| 1 | 0718 | 1740 | 0714 | 1805 | 0651 | 1825 | | 0700 | 1728 |
| 2 | 0718 | 1741 | 0713 | 1806 | 0650 | 1826 | • • • | 0701 | 1728 |
| 3 | 0718 | 1741 | 0713 | 1806 | 0649 | 1827 | | 0702 | 1728 |
| 4 | 0719 | 1742 | 0712 | 1807 | 0648 | 1827 | | 0703 | 1728 |
| 5 | 0719 | 1743 | 0711 | 1808 | 0647 | 1828 | | 0703 | 1729 |
| 6 | 0719 | 1744 | 0711 | 1809 | 0646 | 1828 | | 0704 | 1729 |
| 7 | 0719 | 1744 | 0710 | 1810 | 0645 | 1829 | | 0705 | 1729 |
| 8 | 0719 | 1745 | 0709 | 1810 | 0643 | 1830 | | 0706 | 1729 |
| 9 | 0719 | 1746 | 0709 | 1811 | 0642 | 1830 | | 0706 | 1729 |
| 10 | 0719 | 1747 | 0708 | 1812 | 0641 | 1831 | | 0707 | 1729 |
| 11 | 0719 | 1748 | 0707 | 1813 | 0640 | 1831 | | 0708 | 1730 |
| 12 | 0719 | 1748 | 0706 | 1813 | 0639 | 1832 | | 0708 | 1730 |
| 13 | 0719 | 1749 | 0706 | 1814 | 0638 | 1833 | | 0709 | 1730 |
| 14 | 0719 | 1750 | 0705 | 1815 | 0637 | 1833 | | 0710 | 1730 |
| 15 | 0719 | 1751 | 0704 | 1816 | 0636 | 1834 | • • • | 0710 | 1731 |
| 16 | 0719 | 1752 | 0703 | 1816 | 0634 | 1834 | | 0711 | 1731 |
| 17 | 0719 | 1752 | 0702 | 1817 | 0633 | 1835 | | 0711 | 1732 |
| 18 | 0719 | 1753 | 0701 | 1818 | 0632 | 1836 | | 0712 | 1732 |
| 19 | 0719 | 1754 | 0701 | 1819 | 0631 | 1836 | | 0713 | 1732 |
| 20 | 0718 | 1755 | 0700 | 1819 | 0630 | 1837 | | 0713 | 1733 |
| 21 | 0718 | 1756 | 0659 | 1820 | 0629 | 1837 | | 0714 | 1733 |
| 22 | 0718 | 1757 | 0658 | 1821 | 0628 | 1838 | | 0714 | 1734 |
| 23 | 0718 | 1757 | 0657 | 1821 | 0626 | 1838 | | 0715 | 1734 |
| 24 | 0717 | 1758 | 0656 | 1822 | 0625 | 1839 | | 0715 | 1735 |
| 25 | 0717 | 1759 | 0655 | 1823 | 0624 | 1839 | | 0716 | 1735 |
| 26 | 0716 | 1800 | 0654 | 1823 | 0623 | 1840 | | 0716 | 1736 |
| 27 | 0716 | 1801 | 0653 | 1824 | 0622 | 1841 | | 0716 | 1737 |
| 28 | 0716 | 1802 | 0652 | 1825 | 0621 | 1841 | | 0717 | 1737 |
| 29 | 0715 | 1802 | | | 0619 | 1842 | • • • | 0717 | 1738 |
| 30 | 0715 | 1803 | | | 0618 | 1842 | | 0717 | 1739 |
| 31 | 0714 | 1804 | | | 0617 | 1843 | | 0718 | 1739 |

20

ALARM SYSTEM WITH PROGRAMMABLE DEVICE CONTROL

FIELD OF THE INVENTION

The invention relates to an alarm system providing programmable control of household devices connected to it.

BACKGROUND OF THE INVENTION

Programmable remote control of electrical devices, such as lights, through a main module is known. The commercially available X-10 residential device control system is an example of this. Systems such as these are used mainly in home control applications, performing tasks such as controlling lights, TVs, stereos etc, using a remote control or a programmable schedule. At a site, electrical devices are plugged into control modules which are plugged into the household sockets. A main module is also plugged into a socket at the site. The main module allows programmed control of the devices connected to each control module. To accomplish this, the main module communicates with control modules and devices are activated and deactivated according to a particular scheduled program for each control module. Typically, the user has extensive control over activation schedules for the devices, which makes the system harder to use and increases the chances of programming error.

Further, the programming flexibility of the above device is limited. The scheduled program must be changed as the activation or deactivation times change. In particular, if a porch light is programmed to be activated at a certain time each night, as the sunset time changes for that location, the activation time becomes either too early or too late. Other modifications such as using light sensors to automatically adjust the activation times are costly and the sensors may malfunction through sensor-blocking dirt or breakage.

Systems exist for adjusting activation and deactivation of devices according to specific sunrise and sunset times. See U.S. Pat. Nos. 4,857,759 and 5,254,908. Such systems are limited in their flexibility as they simply activate and deactivate devices and provide no other functionality.

SUMMARY OF THE INVENTION

The present invention provides an alarm security system at a geographic location which is connected to a central reporting station. Within the system there is a programmable control system for selectively activating ancillary devices. The control system comprises a plurality of controllers each connected to the ancillary devices for selectively activating and deactivating the ancillary devices and a programmable activation system to operate each of the plurality of controllers. The activation system establishes the activation and deactivation times for the ancillary devices using location information of the geographic location, user-programmed parameters, the current time, current date and yearly sunrise and sunset times. There is also selection means to set the geographic location of the alarm security system for the programmable activation system.

It is an aspect of the invention to have the above selection means use a telephone number and area code assigned to the alarm security system.

It is a further aspect of the invention to have the selection means rely on a user entering a code to the programmable control system corresponding to the geographic location of the alarm security system.

It is a further aspect of the invention to include a time-randomizing factor into the calculation for the activation or deactivation of the connected devices.

It is a further aspect of the invention to have the yearly sunrise and sunset times stored at the central reporting station and to have the programmable control system communicate with the central reporting station to retrieve those times.

It is a further aspect of the invention to have the programmable control system responsive to the current operation mode of said alarm security system.

For an alarm security system connected to a central reporting station, another aspect of the invention provides a programmable control system for selectively activating a plurality of ancillary devices. The control system comprises a set controllers each connected to the ancillary devices for selectively activating and deactivating the ancillary devices; a microprocessor; access to means to determine sunrise and sunset times for different times of the year for a series of geographic locations; and a program operating on the microprocessor. The program contains an activation module which causes selective activation and deactivation of the controllers. The activation module uses location information of the geographic location itself, the current time, current date, user-programmed parameters and yearly sunrise and sunset times to determine when to activate and deactivate the controllers.

The present invention also provides an integrated system having an alarm system connected to a residential device control system. The alarm system has a programmable output which controls the residential device control system. The residential device control system uses control modules which are plugged into electrical sockets to control electrical devices plugged into the control modules. The residential device control system can programmably activate each control module. Additionally, the alarm panel can be programmed to activate the residential device control system according to a schedule incorporating the changing sunrise and sunset times. There is also selection means to set the geographic location of the alarm system.

BRIEF DESCRIPTION OF THE DRAWINGS

Preferred embodiments of the invention are shown in the drawings, wherein:

FIG. 3 is a partial table of sunrise and sunset times throughout the year for a particular geographic location;

DETAILED DESCRIPTION OF THE PREFERRED EMBODIMENTS

Figure 1:
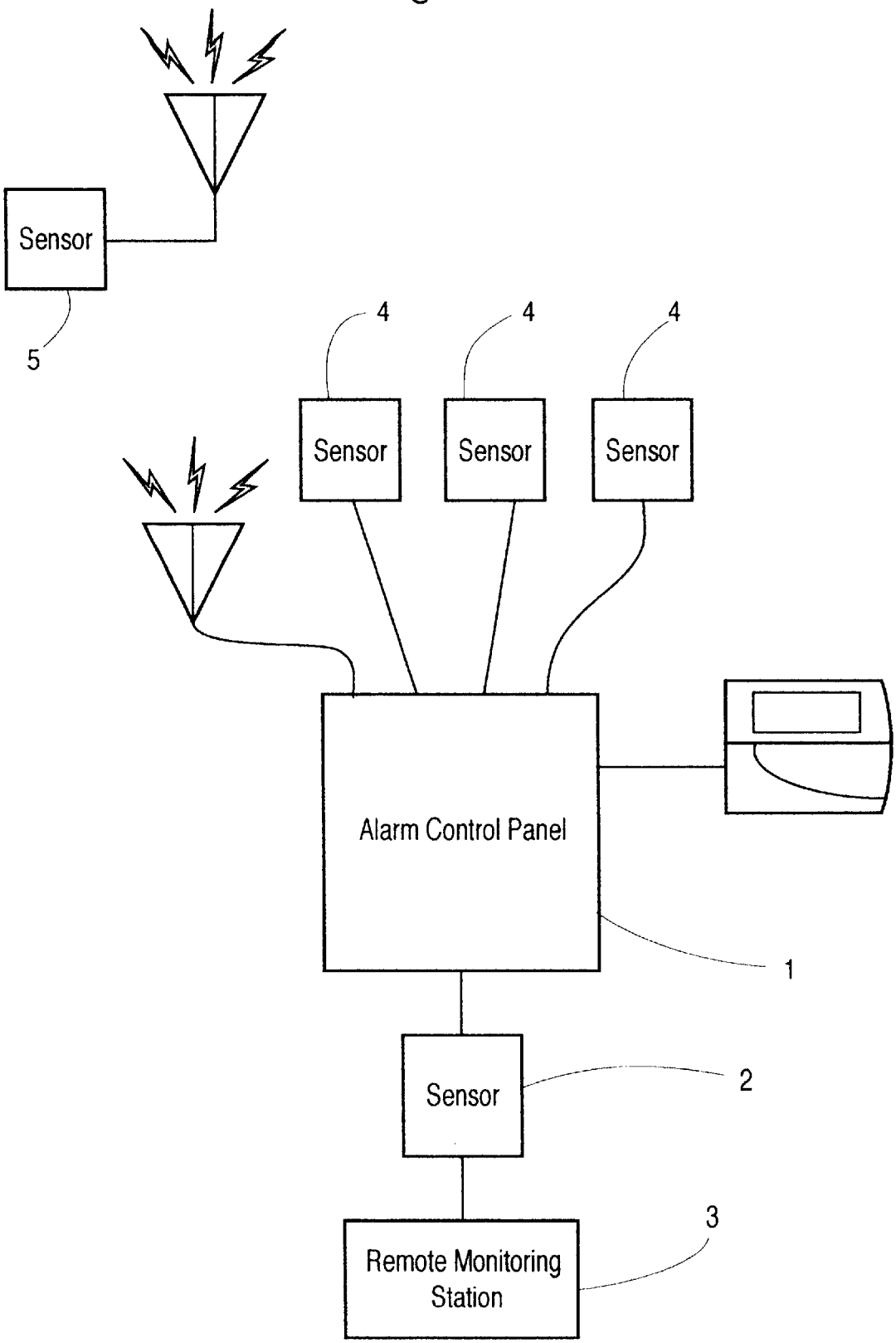
FIG. 1, is a block diagram of a typical alarm panel system located on a site.

A typical alarm security system is shown in FIG. 1. Alarm panel 1 is located at a site being monitored, such as a house or office. Specialized sensors 4 located throughout the site are wired to alarm panel 1. Each sensor can detect specific characteristics, such as motion, heat, vibrations or others ambient characteristics. Other sensors 5 may also be connected via a wireless communications link. Alarm panel 1 monitors the state of each sensor and reports the state of the system to the monitoring station 3 via telephone system 2. If for example, sensor 5 is triggered, this event is recognized by alarm panel 1. After analyzing the event, alarm panel 1 may communicate with the monitoring station to signify an alarm condition at the location. Thereupon, action may be taken at the remote monitoring station to verify the state of the alarm panel and respond to the state.

For the invention, an alarm panel also has a controller connecting the alarm panel to electrically controllable devices, such as lights, electrically-controlled sprinkler systems or other devices. One embodiment of the system has a porch light controller connected to an alarm panel at a house. The alarm panel may be programmed to activate the controller to turn on the porch light automatically at sunset and turn it off at a set time thereafter.

Figure 4:
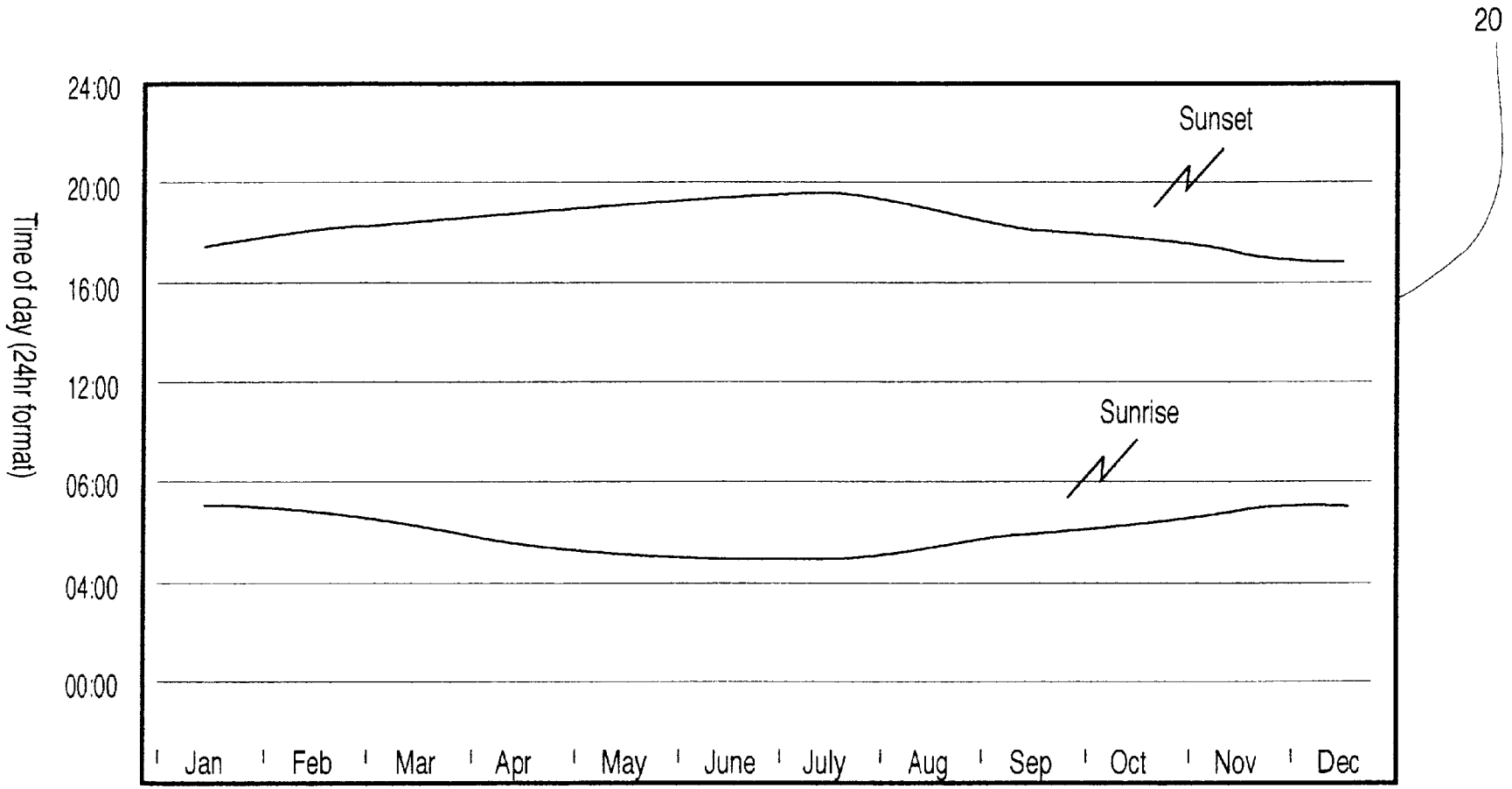
FIG. 4 is a graph plotting sunrise and sunset times throughout the year for a particular geographic location.
Figure 5:
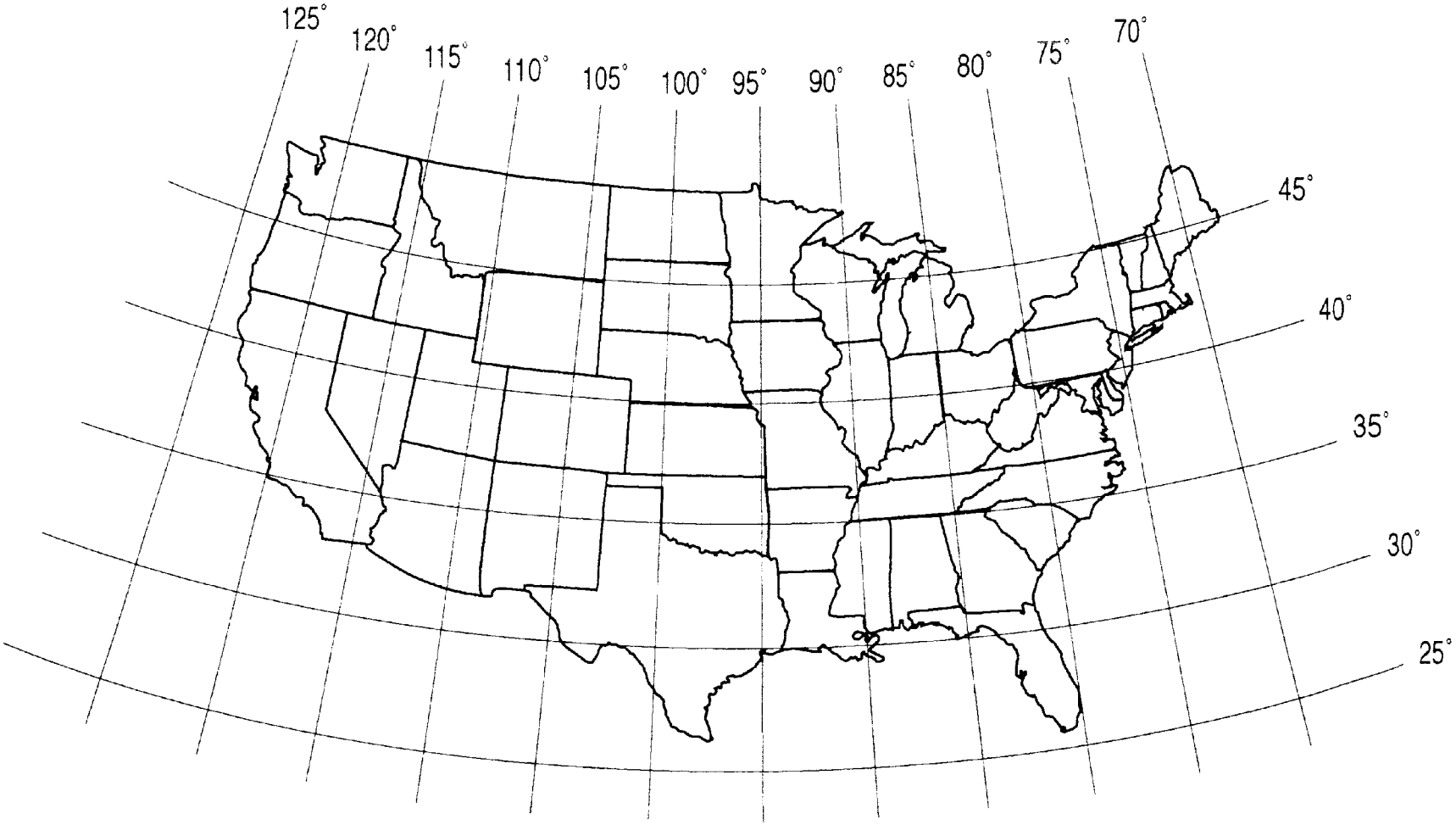
FIG. 5 is a map of the continental United States, showing lines of latitude and longitude.

However, it is known that sunrise and sunset times vary according to the current date and the geographic location. For example, for a given date, the sunrise and sunset times are different at the equator compared to Toronto, Canada. FIGS. 3 and 4 illustrate the varying sunrise and sunset times 20 for a given geographic location for different dates of the year. FIG. 5 is a map of the continental United States showing lines of longitude and latitude. It is known that sunrise and sunset times vary per the latitude of locations.

To accommodate for the above timing characteristics, the invention provides the alarm panel with the ability to automatically adjust its programmed activation and deactivation times based on the current sunrise and sunset times for the given geographic location of the alarm panel.

Figure 2:
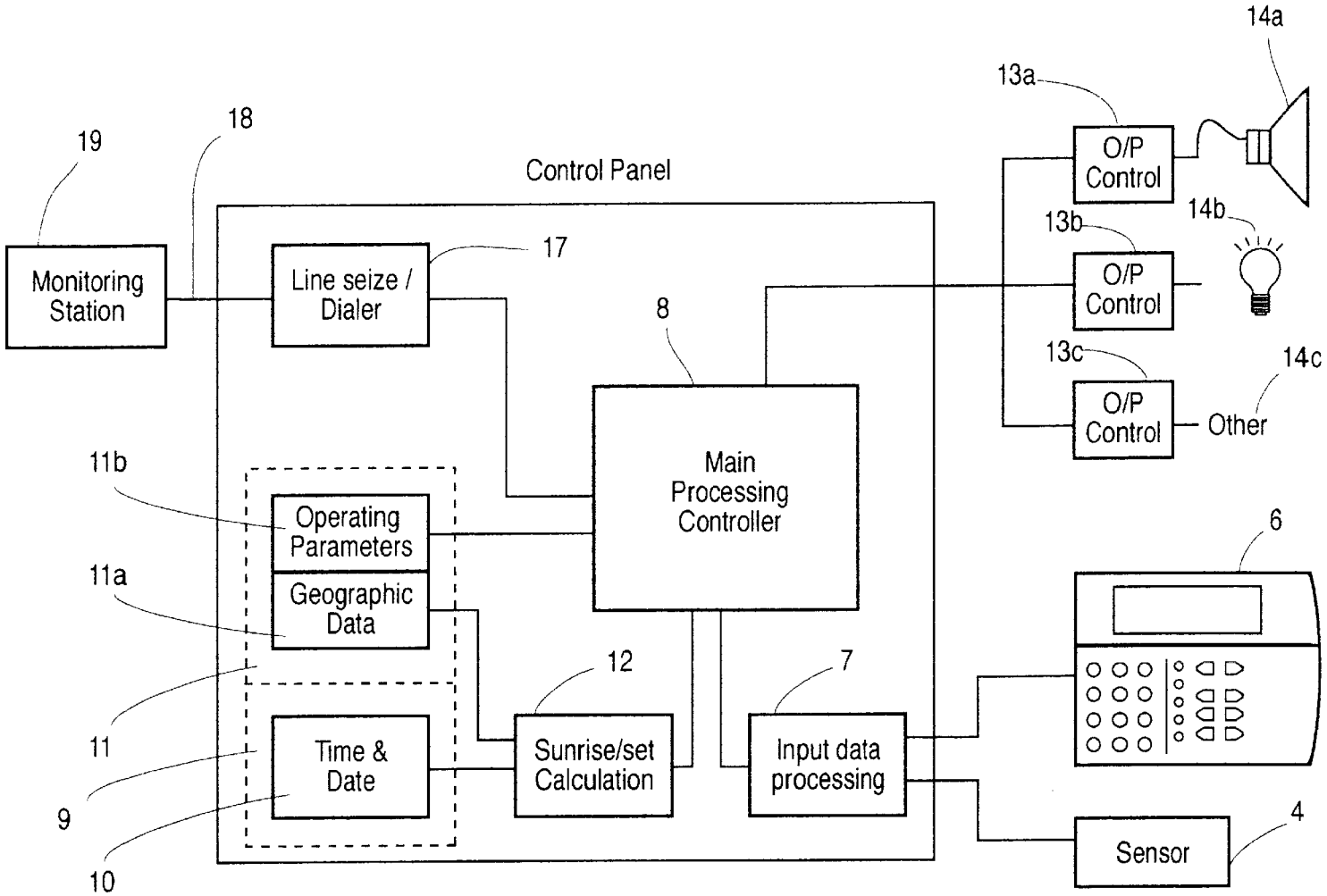
FIG. 2 is a block diagram of an alarm panel system incorporating the invention.

The relevant components of the invention are shown in FIG. 2. Alarm panel 6 comprises input data processing module 7, main processing controller 8, output controllers 13, volatile memory 9, system clock 10, communications controller 17, telephone line 18, operating program 12 and non-volatile memory 11. Nonvolatile memory 11 comprises geographic look-up table 11*a* and system operating parameters 11*b*. Geographic look-up table 11*a* contains data similar to table 20 in FIG. 3, but has sunrise and sunset times for a plurality of geographic locations.

Operating program 12 runs on main processing controller 8 and controls the alarm panel. It may be stored in nonvolatile memory 11. Input signals from sensors, keypads and other devices are received and processed by the operating program. The input signals are compared with the current state of the operating program, and if necessary, the operating program reacts to the input signals. For example, if the alarm panel is in an "armed" state and motion sensor 4 is triggered, the alarm panel can cause output controller 13*a* to trigger appropriate alarm signals to alarm 14*a*. Concurrently, the alarm system status can be reported to monitoring station 19 via telephone link 18. The establishment of the communications link, the communications protocol and the messaging between the alarm panel and the monitoring station are controlled by operating program 12. Telephone line seize/dialer 17 controls the access to the telephone line.

Temporary variables and alarm state conditions used by the main program are stored in volatile memory 9. System clock 10 provides the operating program with the current time and date of the geographic location.

The parameters of the geographic location of the site can be programmed into the operating program by numerous manners. Parameters which sufficiently identify geographic locations for this invention include longitude and latitude coordinates, nearby major city, nearby airport code and telephone area code and exchange. It can be appreciated that while several different parameters may be used, for simplicity the alarm panel may use only one or a few parameters to identify the geographic location.

At the appropriate time, e.g. alarm panel initialization, the operating program will prompt the installer to key-in the geographic location parameters. Specialized codes corresponding to major cities or airports may be provided with the instruction manual of the alarm panel. The installer would identify the nearest major city to the current location on the table, then when prompted, the installer would enter the specialized code associated with it. The activation module would use the code to identify the corresponding geographic location in table 11*a*. Alternatively, the alarm panel may require the to installer to key-in the longitude and latitude coordinates or the area code and telephone number of the site. Another embodiment of the invention automatically determines the geographic location of the alarm panel based on the telephone area code and exchange associated with the alarm panel. An accessible list of the telephone area codes and exchanges may be stored either at the alarm panel or at the monitoring station.

Through the activation module, the operating program controls the activation times of devices connected to the output controllers 13. First, the user forces the operating program into a device activation programming mode. This can be done by entering an appropriate code into the keypad. The operating program then prompts the installer to enter specific activation and deactivation times or other event parameters for a particular controlled device.

The activation module also sets the individual activation and deactivation times for the devices connected to each output controller. This is done according to the parameters set by the installer and the geographic and time information previously set to the program. Using the geographic and time information and the yearly sunrise/sunset times for the geographic location, the activation and deactivation times for devices connected to the output controllers can be automatically varied by the activation module to track the current sunrise/sunset times.

In one embodiment of the invention, the activation module accesses geographic look-up table 11*a* to retrieve the current sunrise and sunset times for the programmed geographic location. Then, for each programmed output controller, the timing parameters and the system clock are used by the activation module to establish an activation and deactivation time for each output controller. Accordingly when either the activation time or the deactivation time matches the system clock, the output controller is toggled to activate or deactivate its connected device.

It can be appreciated that the memory storage required for all the sunrise/sunset tables for each specified geographic location can be relatively large and therefor costly. It can be appreciated that the precision to which the system defines geographic sites and sunrise/sunset times can be varied to meet different computational or memory storage parameters of the alarm system. For example, geographic precision of 10, 100 or 200 kilometers, or sunrise/sunset precision times of 1, 5 or 10 minutes may be used. Less storage requirements are needed as the precision for either parameter decreases.

In another embodiment of the invention, the sunrise/sunset times are adjusted on a less-than-daily frequency basis. In some situations, it may not be necessary to have the connected devices activated or deactivate precisely at sunset or sunrise. As such, it may be sufficient to activate or deactivate the connected devices at the same time for, say, a week, then update the times accordingly. With such a system, the communications traffic between the alarm panel and the monitoring station decreases. Also, the storage requirements for the sunrise/sunset times may also decrease, as the sunrise/sunset times for the location do not require daily data, but says only weekly data.

Another embodiment of the invention provides improved sunrise/sunset calculation times for a geographic location. When the table of sunrise/sunset times contains less precise data, the installer enters into the alarm panel actual sunrise and/or sunset times for the geographic location. The activation module then uses the actual times provided and the data from the table to calculate more precise sunrise and sunset times for the current date and other dates.

In another embodiment of the invention, rather than storing the sunrise/sunset tables at each alarm panel, such tables may be stored at the monitoring station. After the alarm panel obtains the geographic site parameters, the alarm panel communicates with the monitoring station and accesses the central tables at the monitoring station. Thereafter, the alarm panel calculates appropriate activation and deactivation times for that site according to the providing parameters.

Alternatively, the computer system at the monitoring station may access geographic information stored at the local alarm panel and calculate appropriate activation and deactivation times for the devices connected to the local alarm panel. Such times would then be communicated back to local alarm panel. Either the local alarm panel or the monitoring station may then control the output controllers.

In another preferred embodiment, sunrise/sunset times are calculated by the activation module using algorithms stored in the sunrise/sunset calculation module. These algorithms are based on the current date and the geographic site parameters.

It can be appreciated that between the local alarm panels and the monitoring station, the two systems may split (i) the storage of sunrise/sunset times or other system parameters or (ii) the calculation of the sunrise/sunset times or other calculations in other manners which are still within the scope of this invention.

Another embodiment of the invention has the alarm system activating other lights and other devices to give the appearance that the household is occupied by one or more persons. For example living room lights 14*b* may be activated automatically after sunset. Each connected device is turned-off sometime in the evening, to simulate the typical usage of lights or other devices in those rooms. To enhance the simulation, a further embodiment of the invention incorporates a randomizing factor into the activation times for the devices. With the randomization factor, connected devices are activated according to a time randomization factor and sunrise/sunset times for the current date. The period for which the device is activated may also be modified by a randomization factor. For example, for-a single programmed setting, if sunset is at 7:30 p.m., a room light may be activated at 8:00 p.m. and turned off at 9:00 p.m. on a given date. The next day under the same programmed setting, the same light may be activated at 7:35 p.m. and turned off at 10:30 p.m. Without the randomization, the activation times might be 7:30 p.m. on the first date and 7:32 p.m. on the next. The randomization factor calculation and implementation may be controlled by the activation module.

It can be appreciated that other devices 14*c*, not necessarily simple lights, which are electrically controlled, can be connected and controlled by the alarm panel through controller 13*c*. Such devices include radios, televisions, lawn watering systems, swimming pool pumps, swimming pool solar heaters, etc.

It can be appreciated that regional events, for example the transition between daylight savings time and standard time may be a factor in the calculation of the activation or deactivation times. The parameters for daylight savings time may be stored either within the alarm panel or at the monitoring station.

In another embodiment of the invention, the alarm security system provides enhanced operation modes which integrates typical alarm responses and programmed control of electrical devices. In one instance, after the alarm security system is set in its "armed" operation mode and a sensor is triggered, in addition to reporting the alarm condition to the monitoring station and activating appropriate alarm buzzers, specific electrical devices connected to the alarm security system are activated and deactivated in an alarm sequence mode. For example, a porch light or room light may be flashed continuously. In another instance, when the alarm panel is set in a "holiday" operation mode, a pool heater controlled by the alarm security system will not activate at its normally programmed times. While the alarm system is in the "holiday" operation mode, the activation times of the pool heater may be automatically suspended or the heating cycle of the pool heater may be automatically shortened. Where appropriate, the sunrise/sunset times are used by the activation module to determine whether the controlled devices are activated at all.

Another embodiment if the invention provides controlled access to the programming features of the alarm panel. Many alarm panel systems have different access levels for different users. For example, alarm system installers have full access to most, if not all, programming features of an alarm system, while residents typically have access to more limited capabilities (for example activating and deactivating the alarm mode for the alarm system, activating and deactivating different alarm detection modes). Programming features are accessed through the alarm panel.

In order to reduce the possibility of misprogramming the alarm system, the resident may not be given access to the programming modes controlling the activation of electrical devices. Instead, the resident provides the installer with a schedule of activation times for the controlled electrical devices. The installer then programs the alarm system to control the electrical devices in accordance with the schedule. With the invention, instead of having static activation and deactivation times, daily automatic adjustments according to the sunrise and sunset times can be incorporated into the schedule without requiring the installer to make daily programming adjustments to the activation schedule.

Figure 6:
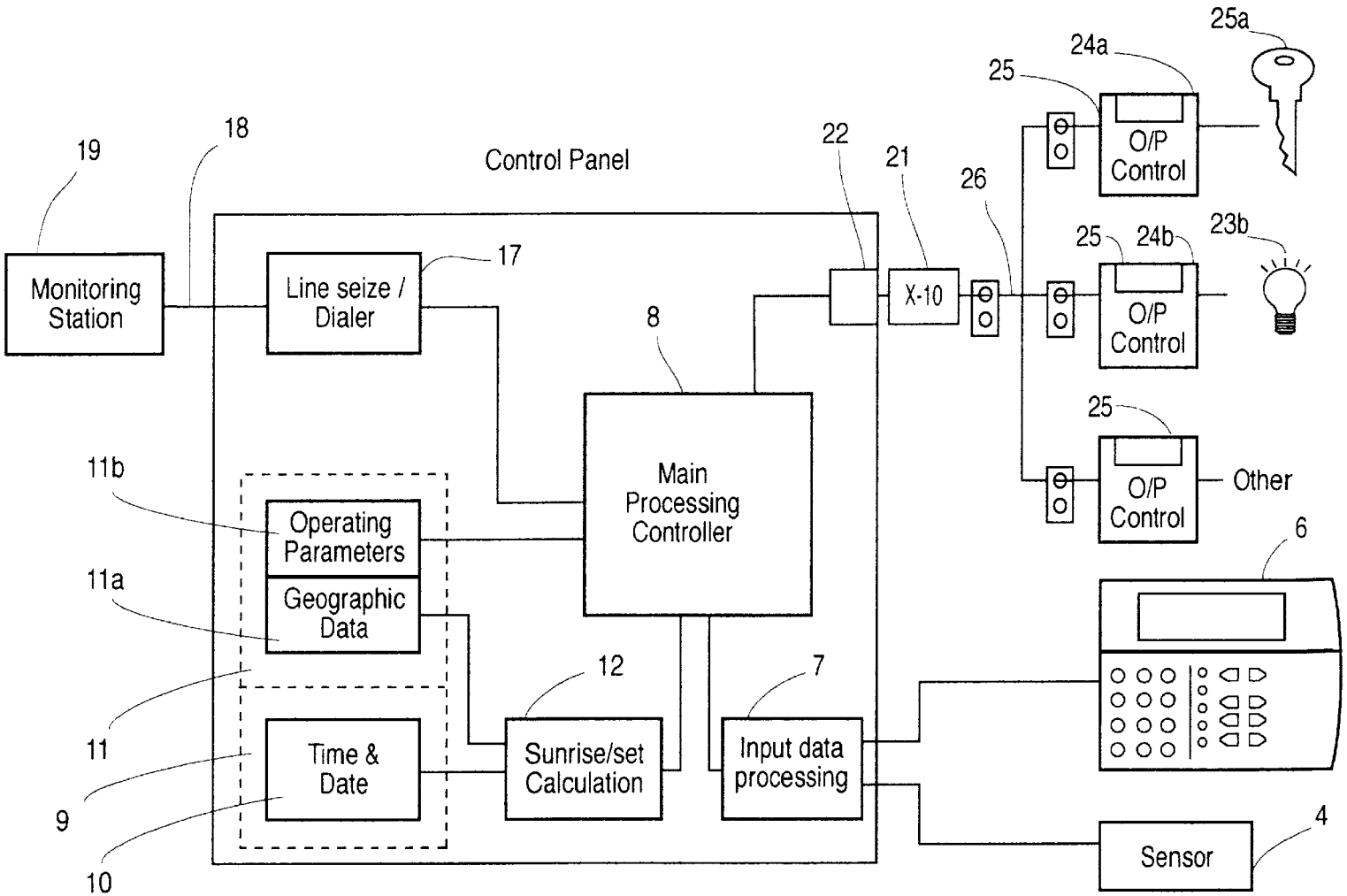
FIG. 6 a block diagram of alarm panel system incorporating another embodiment of the invention.

Referring to FIG. 6, another embodiment of the invention comprises an integrated system having an alarm system controlling a residential device control system, such as an X-10 system 21. Alarm systems are known having programmable outputs, including those from Digital Security Controls Limited. One of the programmable outputs is used to control the X-10 system. The programmable output 22 can be set to activate and deactivate devices connected thereto on daily, weekly and other chronological or event (e.g. alarm status) parameters The X-10 system interfaces with electrical devices (23*a*, 23*b*) via control modules (24*a*, 24*b*) plugged into the household electrical wiring 26. Each control module has a programmable identification code (25*a*, 25*b*). Using the activation schedule for the devices supplied by the resident, the installer programs the X-10 main module 21 with an activation schedule for each control module (24*a*, 24*b*). The alarm panel 6 is then programmed to control the X-10 system according to a schedule incorporating the changing sunrise and sunset times. With such a system, the resident can place and move controlled devices throughout the house by simply moving the control module with the device. In this configuration, alarm panel 6 controls when the X-10 system is active, and when the X-10 system is active, it controls devices 23*a* and 23*b*.

Figure 7:
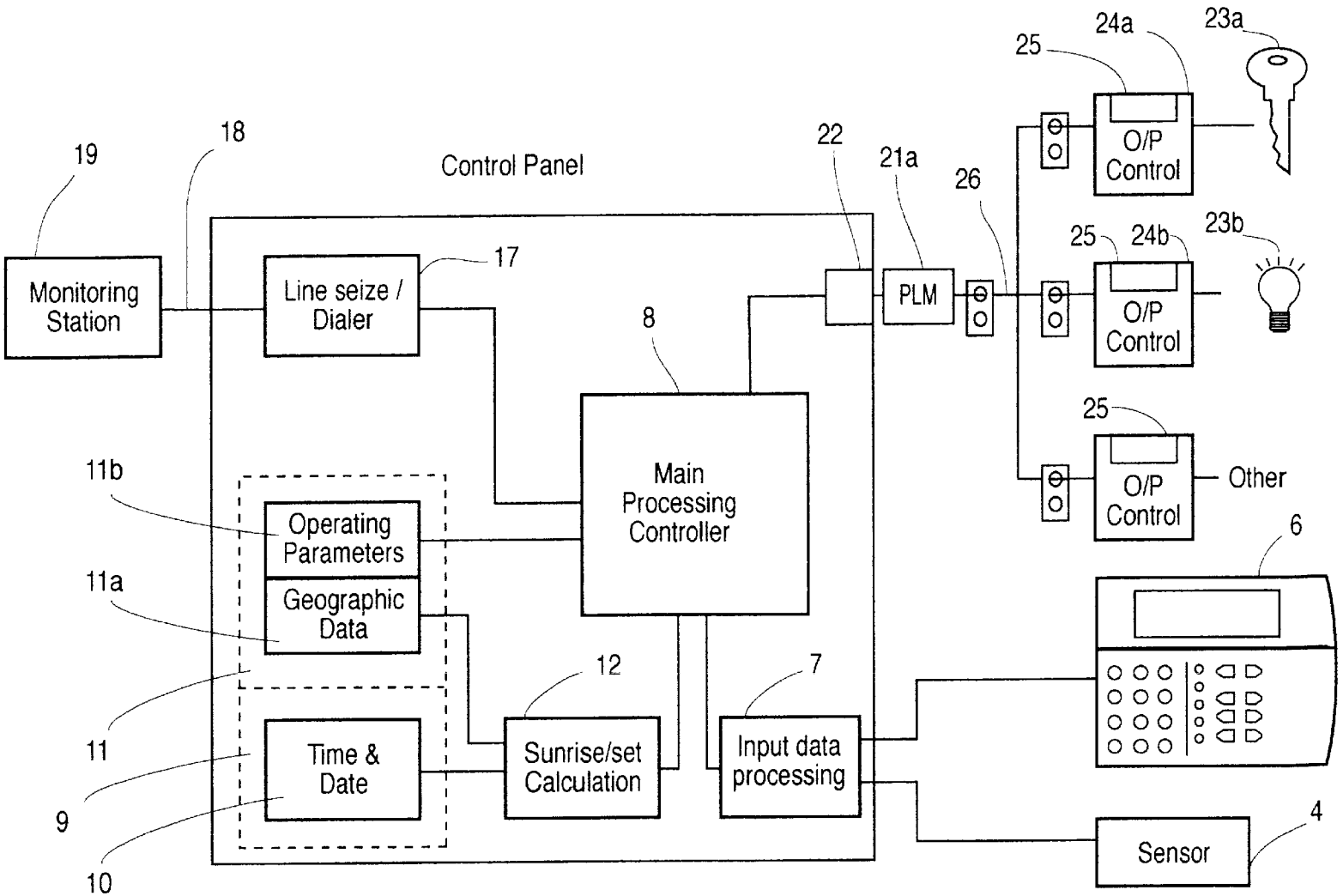
FIG. 7 is a block diagram of alarm panel system incorporating another embodiment of the invention.

FIG. 7 shows another embodiment of the invention where a device control system providing X-10 functionality is connected to an alarm system. Same figure numbers as those in FIG. 6 are used where appropriate. As shown in FIG. 7, programmable output 22 is connected to an X-10 emulator 21*a*, such as Digital Security Control's PLM 513. Emulator 21*a* provides the functionality of an X-10. As such, it can inject control signals onto the residential internal power wiring and communicate with control modules 24*a* and 24*b* over household electrical wiring 26. For example, Escort modules from Digital Security Controls may be used to control electrical devices. Emulator 21*a* is programmed to control devices 23*a* and 23*b* incorporating activation and deactivation adjustments for the sunrise/sunset times. The programing is done through alarm panel keypad 6.

In order to reduce the programming complexity for the alarm panel, the invention may additionally provide a parameter-based programming mode for controlling electrical devices in accordance with the current sunrise and sunset times for the geographic location of the alarm panel. Such parameters include activate on sunset, activate on sunset with time offset, deactivate on sunrise and others.

Although various preferred embodiments of the present invention have been described herein in detail, it can be appreciated that the present invention is not restricted to what is described above, but can be changed or modified in many different ways within the scope of the invention defined in the attached claims.

The embodiments of the invention in which an exclusive property or privilege is claimed are defined as follows:

1. In an alarm security system at a geographic location connected to a central reporting station, a programmable control system for selectively activating a plurality of ancillary devices, said control system comprising a plurality of controllers each connected to said plurality ancillary devices for selectively activating and deactivating said plurality of ancillary devices;

programmable activation means to selectively activate and deactivate each of said plurality of controllers according to programmable parameters comprising user-defined timing parameters, current time, current date and yearly sunrise and sunset times for said geographic location;

selection means to set said geographic location of said alarm security system for said programmable activation means; and wherein said selection means is based on a telephone number and area code associated with said alarm security system.

2. The programmable control system as claimed in claim 1 wherein said yearly sunrise and sunset times are stored at said central reporting station and said programmable control system communicates with said central reporting station to retrieve said yearly sunrise and sunset times for utilization by said programmable activation means.

3. The programmable control system as claimed in claim 1 wherein said programmable parameters further comprise a time randomizing factor.

4. The programmable control system as claimed in claim 2 wherein said plurality of properties on which said programmable activation means operates further comprises a time randomizing factor.

5. The programmable control system as claimed in claim 1 wherein said yearly sunrise and sunset times are stored at said alarm panel.

6. The programmable control system as claimed in claim 1 wherein said plurality of controllers selectively control the flow of electricity to said plurality of ancillary devices.

7. The programmable control system as claimed in claim 1 wherein said programmable activation means is responsive to operation modes of said alarm security system to selectively control said ancillary devices.

8. The programmable control system as claimed in claim 2 wherein said plurality of properties further comprises actual sunrise/sunset times for a specific date provided to said alarm security system.

9. In an alarm security system connected to a central reporting station, a programmable control system for selectively activating a plurality of ancillary devices, said control system comprising a plurality of controllers each connected to said plurality ancillary devices;

a microprocessor;

accessible data for sunrise and sunset times for different times of the year for a plurality of geographic locations;

selection means to set a specific geographic location for said alarm panel from said plurality of geographic locations;

a program operating on said microprocessor, said program comprising an activation module causing selective activation and deactivation of said plurality of controllers based on a plurality of properties comprising identification of said geographic location, current time, current date, and yearly sunrise and sunset times for said geographic location; and wherein said geographic location is established via a telephone number and area code associated with said alarm security system.

10. The programmable control system as claimed in claim 9 wherein said yearly sunrise and sunset times are stored at said central reporting station and said programmable control system communicates with said central reporting station to retrieve said sunrise and sunset times for utilization by said programmable activation module.

11. The programmable control system as claimed in claim 9 wherein said programmable parameters comprise a time randomizing factor.

12. The programmable control system as claimed in claim 9 wherein said program adjusts activation and deactivation times of said plurality of controllers at most on a daily basis.

* * * * *